US006616375B1

(12) United States Patent
Eriksson

(10) Patent No.: US 6,616,375 B1
(45) **Date of Patent: *Sep. 9, 2003**

(54) ARRANGEMENT IN A DRAIN SYSTEM AND A METHOD FOR TAKING CARE OF DRAIN MEDIA

(76) Inventor: Bertil Eriksson, Markvägen 1 D, Själevad SE-890 23 Själevad (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/623,535

(22) PCT Filed: Feb. 25, 1999

(86) PCT No.: PCT/SE99/00263

§ 371 (c)(1),
(2), (4) Date: Nov. 17, 2000

(87) PCT Pub. No.: WO99/45213

PCT Pub. Date: Sep. 10, 1999

(30) Foreign Application Priority Data

Mar. 4, 1998 (SE) ..... 9800664

(51) Int. Cl.[7] ..... E02B 11/00; E04H 7/00

(52) U.S. Cl. ..... 405/51; 405/52; 405/36; 405/37; 210/167; 210/170; 210/747; 137/236.1

(58) Field of Search ..... 405/36, 37, 43, 405/51, 52; 210/163, 167, 170, 747; 137/236.1

(56) References Cited

U.S. PATENT DOCUMENTS

| | | | | | |
|---|---|---|---|---|---|
| 272,728 | A | * | 2/1883 | Martindale | 405/51 X |
| 3,211,167 | A | * | 10/1965 | Clift et al. | 137/236.1 |
| 3,703,960 | A | * | 11/1972 | Kennedy | 210/170 X |
| 3,730,884 | A | * | 5/1973 | Burns et al. | 210/170 X |
| 4,120,312 | A | * | 10/1978 | Michael | 137/236.1 |
| 4,246,925 | A | * | 1/1981 | Oldfelt | 137/236.1 X |
| 4,824,572 | A | * | 4/1989 | Scott | 210/747 X |
| 4,930,934 | A | * | 6/1990 | Adkins | 405/37 |
| 5,133,622 | A | * | 7/1992 | Hewlett | 405/43 X |
| 5,192,426 | A | * | 3/1993 | DeCoster et al. | 210/170 X |
| 5,221,158 | A | * | 6/1993 | Norsworthy | 405/43 |
| 5,350,251 | A | * | 9/1994 | Daniel | 405/37 |
| 5,356,274 | A | * | 10/1994 | Lee | 417/435 |
| 5,441,632 | A | * | 8/1995 | Charon | 210/170 |
| 5,498,330 | A | * | 3/1996 | Delle Cave | 405/37 X |
| 5,895,569 | A | * | 4/1999 | Connelly | 210/170 |
| 5,944,444 | A | * | 8/1999 | Motz et al. | 405/37 |
| 6,000,880 | A | * | 12/1999 | Halus | 405/52 |
| 6,102,618 | A | * | 8/2000 | Takada et al. | 405/52 |
| 6,261,443 | B1 | * | 7/2001 | Eriksson | 210/138 |

FOREIGN PATENT DOCUMENTS

| | | | |
|---|---|---|---|
| DE | 3520359 | * 12/1986 | 210/163 |
| WO | 91/01943 | 2/1991 | |
| WO | 97/21003 | 6/1997 | |

* cited by examiner

*Primary Examiner*—Jong-Suk (James) Lee
(74) *Attorney, Agent, or Firm*—Dilworth & Barrese LLP

(57) ABSTRACT

An arrangement is provided in a drain water system having a main drain conduit which is designed as a closed ring conduit (19), and pump members (17, 18) are arranged to pump drain media emanating from different buildings (6) to and into the ring conduit for transport therein through pumping action. Devices (27–31) for taking care of drain media are connected to the ring conduit through a branch (12, 13) each. Valve members (24, 25, 32) are arranged in each connection to the ring conduit and optionally controllable so as to either open in the case of a feed connection and allow pumping of drain media into the ring conduit and in the case of a device connection allow drainage of drain media from the ring conduit, or close to stop drain media from flowing into or out of the ring conduit.

26 Claims, 3 Drawing Sheets

ARRANGEMENT IN A DRAIN SYSTEM AND A METHOD FOR TAKING CARE OF DRAIN MEDIA

FIELD OF THE INVENTION AND PRIOR ART

The present invention relates to an arrangement in a drain system, said drain system having a first system section located in a building and adapted to receive drain media from one or a plurality of units as well as a second system section having a main drain conduit in common to a plurality of buildings provided with a first system section and adapted to conduct drain media to one or a plurality of devices for taking care thereof, as well as a method.

Drain media is preferably constituted by drain water, in which said units may be toilets, draining gutters, sinks, wash-hand basins, dishwashers, washing machines and the like, but any other type of drain media is also comprised, and it would for example be possible to transport organic domestic wastes ground into a finally divided form in such a drain system.

However, arrangements and methods of this type already known only transport drain water from the buildings, and a main disadvantage of this prior art is that it is necessary to think far ahead into the future when planning a settlement and try to predict each conceivable expansion of the settlement so that future settlement or buildings may be connected to the same drain system, i.e., to the same main drain conduit. The reason for this is that all the drain water in such arrangements already known has to flow in one direction in the main drain conduit and deeper and deeper into the ground should not the ground profile be inclined in the direction of the main drain conduit. Thus, it is not possible to connect new buildings located on a comparatively low level with respect to other buildings connected to the drain system at a later stage, would not this have been planned from the beginning by digging and locating the main drain conduit sufficiently deep for enabling flowing of drain water from the new settlement to the main drain conduit. Besides the disadvantage that separate drain systems may be necessary for additional settlements, the result of said planning for the future desired is that the entire drain system will be strongly over-dimensioned until the erection of buildings has been "finished", which may well take tens of years. This means of course a bad utilizing of the investment in the drain system.

Another disadvantage is, as indicated above, that it will be necessary to put the main drain conduit comparatively deep into the ground at certain locations so as to be able to utilize the gravitation in the way desired, which results in very high costs for digging to put the conduits down and also in later problems with tubing fractures and ground water influence as a consequence of the deep localization of the conduits.

SUMMARY OF THE INVENTION

The object of the present invention is to provide an arrangement and a method of the type defined in the introduction, through which the disadvantages mentioned above of such arrangements and methods already known are reduced to a large extent.

This object is according to the invention obtained by designing the main drain conduit of an arrangement of the type defined in the introduction as a closed ring conduit, pump members are arranged to pump drain media emanating from said first system section to and into the ring conduit for transport therein through pumping action, said devices are connected to the ring conduit through a branch each, and valve members are arranged in each connection to the ring conduit and optionally controllable so as to either open so as to allow pumping of drain media into the ring conduit in the case of a feed connection and so as to allow drainage of drain media from the ring conduit in the case of a device connection or close so as to not allow the drain media there to flow into or out of the ring conduit, as well as a method.

By designing the main drain conduit as a closed ring conduit and carrying out the transport of drain media therein through pumping action, the drain media may move in any direction in the main drain conduit. Thus, no height of fall is required along the main drain conduit between the places where drain media is intended to enter into the main drain conduit and the places in which it goes out thereof to said devices, such as purifying plants, but the places last mentioned may even be located on a higher level than those first mentioned. This means in its turn that the ring conduit may be put at a desired depth under the ground surface, for example in the order of 0.5 m, everywhere, so that the tubings may be put into the ground to a low cost. It will of course be considerably less costly than before to dig and reveal the tubings, would this against the expectations be necessary at any time in the future. It is in this way also possible to avoid problems of influence of ground water on the tubing and the environment thereof. Furthermore, it will be very easy to connect new buildings or settlements at a later stage to the main drain conduit, since there is no requirement that the conduits emanating therefrom and leading to the ring conduit have a height of fall with respect to the ring conduit. Another advantage of producing transport of drain media through pumping is that the dimensions of the tubings of the ring conduit may be made considerably smaller than the conventional main drain conduits, since filled conduits are utilized, which of course also results in a saving of costs with respect to the cost for the tubings and for digging and putting them into the ground.

According to a preferred embodiment of the invention said first system section has at least one container for collecting drain media received from said units so as to enable pumping of drain media out from the respective container to the main drain conduit through the pump members at time intervals. It will in this way be possible to utilize the volume of the main drain conduit to an optimum and let for example a certain group, such as a block, of buildings pump out water collected in said container during a certain period of time, for example one day or half a day, during a predetermined period of time into the main drain conduit, such as for example during three hours of the day, while the main drain conduit may be reserved for other groups of buildings during other parts of the day.

According to another preferred embodiment of the invention, which constitutes a further development of the preceding one, pump members are connected to different feed connections to the main drain conduit from different buildings or groups of buildings controllable to pump out drain media into the ring conduit during different periods of time of the day. By such a so called sequence pumping peaks of load on the ring conduit, such as in the morning and in the evening, are avoided and the ring conduit has not to be dimensioned for such peaks, but it may be given a comparatively small dimension by utilizing thereof to an optimum by distributing the load over different periods of time of the day.

According to another preferred embodiment of the invention the arrangement has at least one collecting conduit for drain media in common to a group of buildings and the first system section there of for a connection of the building of the group of buildings in common to the ring conduit, and the conduit is formed by a closed sub-ring conduit having a branch leading to the main drain conduit. Drain water from the different buildings of one or a plurality of blocks may by such a sub-ring conduit be efficiently absorbed.

According to another preferred embodiment of the invention the different buildings in said group of buildings have conduit connections to a place in common located on a low level for transport of drain media to said place through the influence of the gravitation, and a pump member in common is arranged in this place to pump drain media out through said feed conduit in question to the ring conduit. The number of pump members required for bringing drain media out into and transport it in the ring conduit may by this be considerably reduced. It may also be an advantage that traditional drain conduits with self-fall already there may be used for conducting drain media from the different buildings.

According to another preferred embodiment of the invention said first system section is divided into at least two parts, namely a first part adapted to receive drain media of a first type from one or a plurality of first units and a second part adapted to receive drain media of a second, different type from one or a plurality of second units, and said pump members are adapted to produce a supply of drain media of one type at the time to the ring conduit. By separating different types of drain media in this way, such as for example drain water of different degree of contamination, and maintain this separation by supplying drain media of one type at the time to the ring conduit drain media of a certain type may be controlled to a quite particular of these devices for taking care of and utilizing the drain media in question to an optimum.

According to another preferred embodiment of the invention said first system section is divided into at least two parts, namely a first part adapted to receive drain media of a first type from one or a plurality of first units and a second part adapted to receive drain media of a second, different type from one or a plurality of second units, and the respective feed connection to the ring conduit from the respective building or building group has at least two parallel conduits, one for drain media of each said type, and the ring conduit has at least two conduits extending in parallel for receiving and transporting drain media of different types. It will be possible by such a design to carry out the separation desired of drain media of the buildings and maintain this all the way to the different devices, but nevertheless transport drain media of different types simultaneously completely independent of each other. Another advantage of this embodiment is that one and the same conduit may be used for drain media of different types and by that no harmful intermixing of components of a drain media at another stage, maybe in some quite particular later use of the drain media, may take place.

According to a preferred embodiment of the invention, which constitutes a further development of the two embodiments last mentioned, said first part is adapted to receive first drain water contaminated to a comparatively high degree and the second part is adapted to receive second drain water normally contaminated to a lower degree. It may then be a question of drain water emanating from toilets as the first drain water, i.e. so called black water, and from sinks, wash-hand basins, draining gutters and the like, so called blue or green water, as other drain waters. These different types of drain water may be used in quite different ways, in which for example black water is suited as fertilizing means and as a material for production of biological gases, while the blue-green water could be used for watering purposes, be brought through a thick ground layer of sand, gravel or another land-filling material for giving large possibilities to mechanical as well as biological purifying of contamination fractions not desired and present in water delivered or just simple led out into a watercourse, since this is considered to be most acceptable from the environmental point of view by a slow drainage through this ground layer.

According to another preferred embodiment of the invention the arrangement has a conduit for connecting a watercourse to the ring conduit as well as a pump member arranged in this connection conduit and adapted to pump water from the water course out into the ring conduit for a purpose of fire fighting, and the ring conduit has one or a plurality of water drainage members for utilizing water pumped from the watercourse for the purpose of fire fighting. A ring conduit may in this way be utilized for ensuring that different blocks of buildings located there along may receive nearly an unlimited amount of water for fire fighting purposes when this is required.

According to another preferred embodiment of the invention the ring conduit has at least one ejector pump for influencing the drain media to flow in a certain direction in the ring conduit. By arranging such a pump drain media may flow in the conduit also when the pump is switched off, at the same time as it will be possible to influence drain media to flow in a certain direction so as to maybe get a shorter way to go to a determined device mentioned.

According to another preferred embodiment of the invention the tubing/tubings of the ring conduit has a diameter below 100 mm. Calculations have even shown that it is possible to manage with tubings having a diameter below 75 mm, more exactly in the order of 50 mm for a ring conduit running and receiving water from city settlement in the form of houses having several floors. Such thin tubings are much easier to dig into the ground than the main drain conduits of drain systems known until today being giant-like with respect thereto.

The advantages of the different embodiments of the method according to the invention appear from the discussion above of different embodiments of the arrangement according to the invention.

Further advantages as well as advantages features of the invention appear from the following description.

DESCRIPTION OF THE DRAWINGS

With reference to the appended drawings, below follows a description of preferred embodiments of the invention cited as examples.

In the drawings.

DETAILED DESCRIPTION OF PREFERRED EMBODIMENTS OF THE INVENTION

Figure 1:
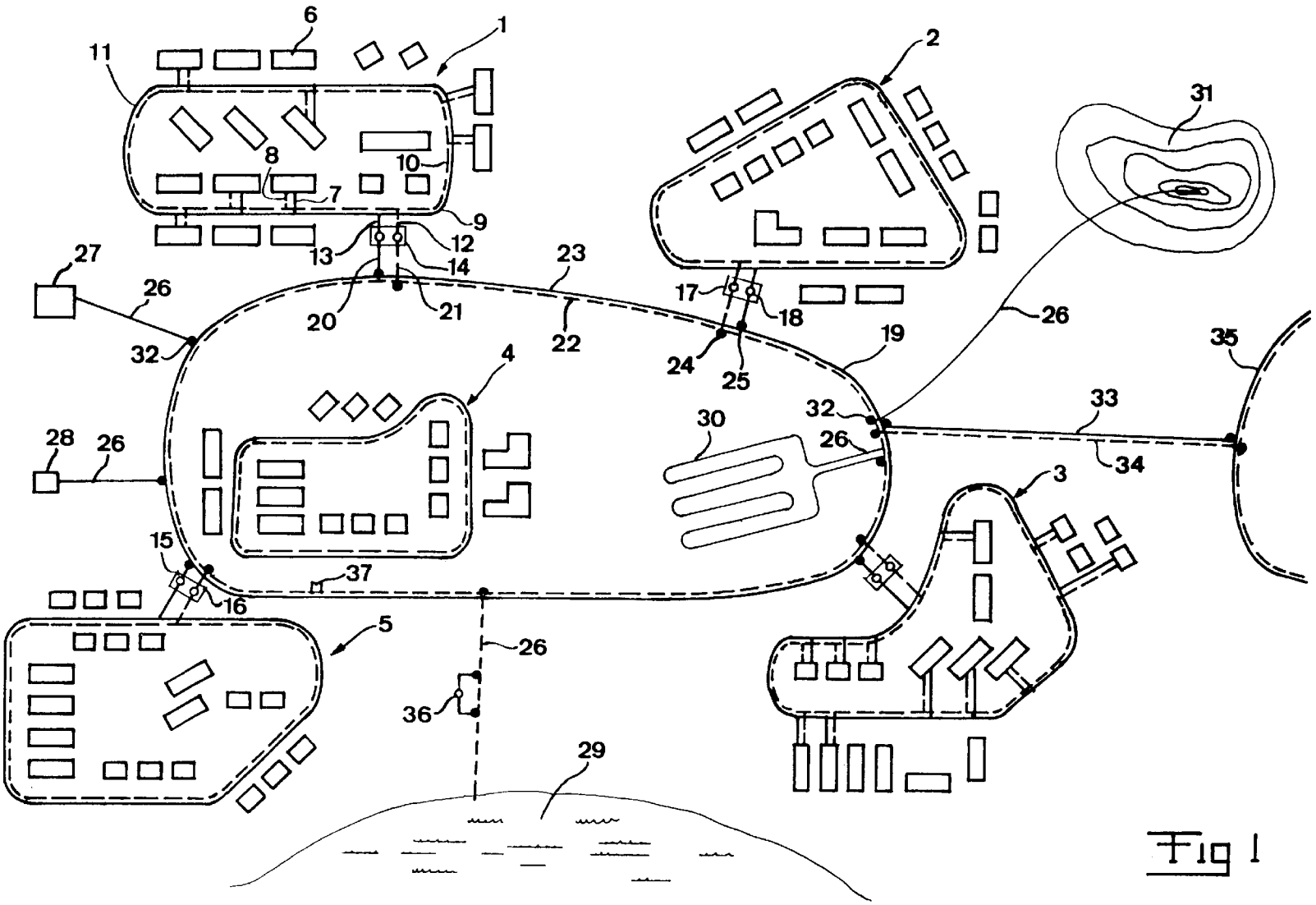
FIG. 1 is a schematic general view of an arrangement in a drain system according to a first preferred embodiment of the invention.

An arrangement in a drain system according to a first preferred embodiment of the invention is illustrated in FIG. 1. A number of buildings 6 arranged in different building groups or blocks 1–5 are connected to a drain system, in which a first system section is arranged in each of these buildings to receive drain media, in the present case drain water, from one or a plurality of units, such as toilets, draining gutters, wash-hand basins, dishwashers, washing machines and the like, in which a division thereof into drain water of different degree of contamination is intended to take place, preferably into so called black water from toilets and blue-green water from the other units. Two conduits 7, 8 run from each building 6 to a conduit 9, 10 each of a closed sub-ring conduit 11 acting as a collecting conduit for drain media in common for the block in question. The tubings 9 and 10 of sub-ring conduit 11 are through two branch conduits 12, 13 connected to a so called pump pit 14, which is located on low level for transport of drain media through the influence of gravitation from the sub-ring conduit thereto. It is in this case possible that pump members not shown are arranged in connection to each conduit 7, 8 from the buildings to the sub-ring conduit or that the sub-ring conduit is arranged with the lowest point thereof at the connection to the branch conduits 12, 13 for transport of drain media through the gravitation also in the sub-ring conduit 11. However, the case first mentioned would be to prefer. It is pointed out that the drawings are strongly schematic and conduits run for example from each building to the sub-ring conduit, although only some are shown.

Collection containers 15, 16 for the respective type of drain media as well as a pump member 17, 18 connected to each container 15, 16 are present in the pump pit 14, said pump member being adapted to pump out drain media contained in said container therefrom to a main drain conduit 19 in the form of a closed ring conduit, which is winding through the community in question, and which is arranged to receive a drain media from the different blocks. In the connection conduits 20, 21 from the different containers to the two tubings 22, 23 of the ring conduit 19 extending in parallel valves 24, 25 are arranged to open for communication between the respective tubing of the ring conduit and the connection conduit 20, 21 in question and close and interrupt such a communication, respectively.

Devices 27–31 for taking care of drain media coming from the buildings and connected to the ring conduit 19 through branch conduits 26 are also parts of the arrangement. A valve member 32 is arranged in each such branch conduit 26 at the connection thereof to the ring conduit and controllable to open or close for enabling drainage of drain media from the drain conduit 19 and preventing that drain media to flow out of the ring conduit to the respective device 27–31, respectively.

The different devices 26–31 are in the present case of the following types: the devices 27 is a gas works, to which so called black water or as an alternative organic material, which could be domestic waste ground in the respective building, are sent for production of biological gas. The device 28 may also be arable land, to which black water or organic material is led for fertilizing purposes. It would here also be possible to have an additional conduit to this device for conducting blue-green water for watering purposes. The device 29 is constituted by a watercourse, such as a lake, to which drain water of a contamination degree being acceptably low from the environmental point of view may be supplied. The device 30 is formed by a loop for watering of parks, cultivations, allotment-gardens, agriculture fields, gardens etc. through watering conduits leaking, and the principle of this device will be explained more in detail further on with reference to FIG. 3. Finally, the device 31 is formed by a thick ground layer of sand in the form of a hill forming a sand filter adapted to receive drain media having heavy metals from the main drain conduit, preferably blue-green water, so as to absorb these heavy metals. This device will be explained more in detail further on with reference to FIG. 4.

Finally, it is illustrated how the ring conduit 19 may through the connection conduit 33, 34 be connected to another such ring conduit 35, which indicates that it would be possible to extend the drain system in the future should that be desired.

The function of the arrangement in a drain system just described and schematically illustrated in FIG. 1 is the following: a separation of drain media into different types, such as drain water of different degree of contamination, for example black water and blue-green water, takes place in each building, and these drain media are brought in the sub-ring conduit 11 and the two conduits 12, 13 separated to the containers 15, 16 in the pump pit 14. Each block may have a certain time in the day to dispose over for getting rid of the drain water collected in the containers 5, 16, in which it is for example possible that two or more blocks have such a time in common. The important thing is that the hours of the day (24 hours) are utilized in the best way possible for obtaining an even distribution of the load on the ring conduit 19. When it is time to empty the containers 15, 16 of for example the block 1 and the valve members 24, 25 associated therewith are opened, and drain water is pumped through the pump members 17, 18 out into the ring conduit 19. The valve members to the blocks which do not have to pump out drain water into the ring conduit 19 at this moment of time are kept closed, which is also valid for the valve members leading to the devices 27–31 which are not intended to receive any drain media pumped out into the ring conduit 19. However, the valve members leading to the device going to receive drain water are opened. All valve members except from the one leading to the device 27 and 29 may for example be closed, so that the blue-green water pumped into the drain conduit 19 disappears therefrom the lake 29 and the black water goes to the gas works.

By distributing the load on the ring conduit 19 in this way on the different hours of the day it will be possible to make the dimension of the tubings thereof considerably smaller than for conventional main drain conduits and a possible dimension is a diameter of 50–75 mm. This means in its turn that the conduits in question may be delivered in coils of 50–100 m instead of the systems already known with lengths of maximum 6 m. The conduits will in this way of course be less costly and also easier to lay down. In addition thereto, since the transport of drain media in the conduits takes place through pumping action, no level differences are required, so that the conduits have not to be put deeper under the ground level than to ensure that they are not influenced by the frost in the ground. Thus, they may be laid on a depth of about 0.5 m instead of a depth of several meters in the drain systems already known, which will be considerably less costly. This ring conduit technique is based on filled tubes and comparatively high speeds, which means that depositions are not resulting in the tubes. By this design of the main drain conduit as a ring conduit 19 the drain system may grow freely and new small sub-ring conduits may all the time be connected thereto. As an alternative, it is of course possible to directly connect buildings to the ring conduit.

It is also shown how pump members 36 in the form of an ejector pump are arranged for pumping water from the watercourse 29 out into the ring conduit 19 for fire fighting purposes, in which the ring conduit has water draining members 37 in the form of fire-plugs in different places for utilizing water pumped from the watercourse for fire fighting purpose. Unlimited amounts of water may in this way be supplied to a fireplace anywhere along the ring conduit 19. The ring conduit may also be utilized for watering through the water from the lake 29 by utilizing the pump member 36 during "work free" hours in the summer.

Figure 5:
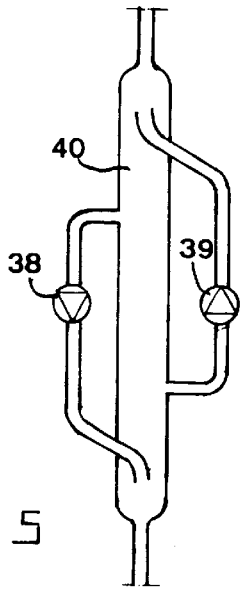
FIG. 5 is a detailed view illustrating how ejector pumps may be arranged in the ring conduit forming the main drain conduit for selecting the transport direction of drain media inside the ring conduit.

The ring conduit 19 does not require any pump member arranged therein, but it could very well accept that drain media entering it from the entrance point flows in both directions in the ring conduit, but it is also possible, as illustrated in FIG. 5, to provide the ring conduit with two ejector pumps 38, 39 directed in opposite directions, which are connected in parallel with a thicker conduit portion 40 of the very ring conduit. By starting one of these ejector pumps drain media in the ring conduit may be influenced to flow in the pump direction of the pump, so that an optional adjustment of the transport direction of the drain media in the ring conduit may take place in this way.

Figure 2:
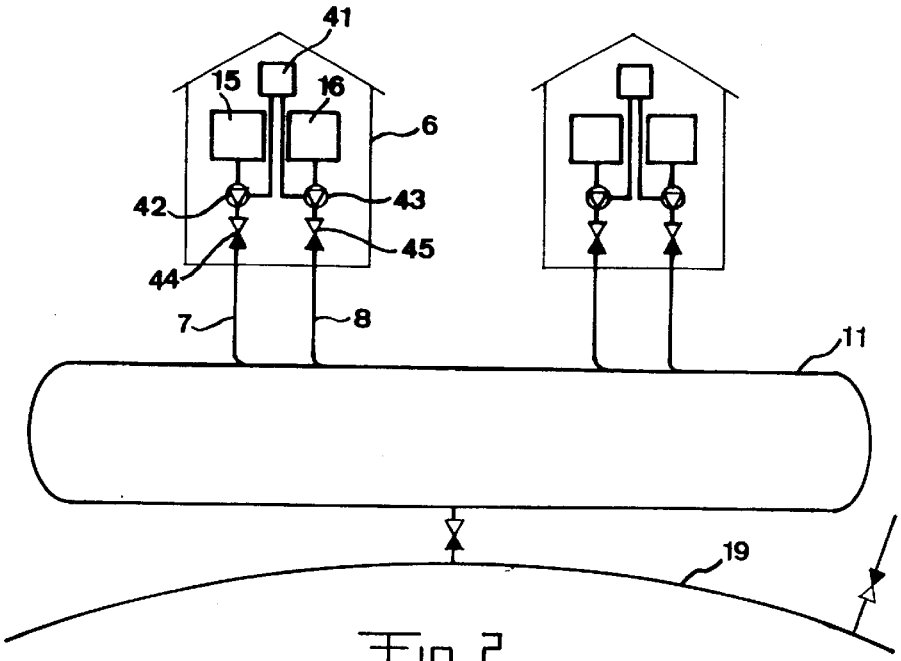
FIG. 2 is a view of a part of an arrangement in a drain system according to a second preferred embodiment of the invention.

A part of an arrangement in a drain system according to a second preferred embodiment of the invention is illustrated in FIG. 2, in which this figure is schematised to a large extent, since only two buildings 6 are connected to the sub-ring conduit 11. A collection container 15, 16 for drain water of different degree of contamination are in this embodiment arranged in the respective building. A control unit 41 is adapted to control two pump members 42, 43 associated with the containers. Valve members 44, 45 are also arranged in the feed conduits 7, 8 to the sub-ring conduit 11. The sub-ring conduit 11 has in this embodiment one single tubing, and the same is valid for the.main ring conduit 19. For maintaining the separation taking place in the building 6 drain media of one single type at the time is in this embodiment intended to be pumped out into the sub-ring conduit 11 and further to the ring conduit 19.

The device 30 is illustrated a little bit more in detail in FIG. 3, in which blue-green drain water is intended to be received from the ring conduit 19 in a pump house 46 for pumping thereof into one of two loops, namely one 47 located close to the ground level, for example on a depth of about 20 cm, while the other 48 is located below the level for the frost in the ground in the winter. A suitable valve member for controlling the drain water to move in the loop 47 in the summer and in the loop 48 in the winter is present in the pump house 46. The tubes of these loops are perforated, so that water may exit into the surrounding ground for watering purposes.

Figure 4:
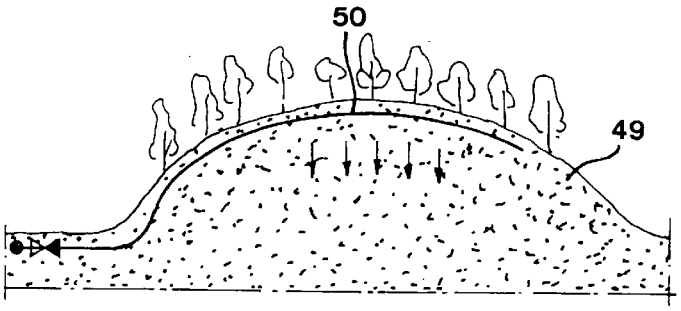

A similar arrangement is done in the device according to FIG. 4, where blue-green drain water is led up into a sand hill 49 through a perforated tube 50 and delivered to the hill, so that the water may move downwardly in the ground by being mechanically as well as biologically cleaned from fractions contaminated and not desired present in the water delivered at a considerable distance above the ground water level.

The different pump members and the valve members of the drain system according to the invention are preferably controlled by a comparatively simple data unit or computer, since only supervising of the need of emptying of the different tanks (collection containers) and where it is most suitable to send a certain drain medium at a certain moment is required.

In a possible power failure it is still possible to press the drain media to the correct device by connecting a drink water conduit to the system, so that then only as much drink water as the amount of drain media transported away is consumed.

The blue-green water could also, as an emergency solution, be drained through the surface water system of the settlement continuously working with self-fall.

Figure 6:
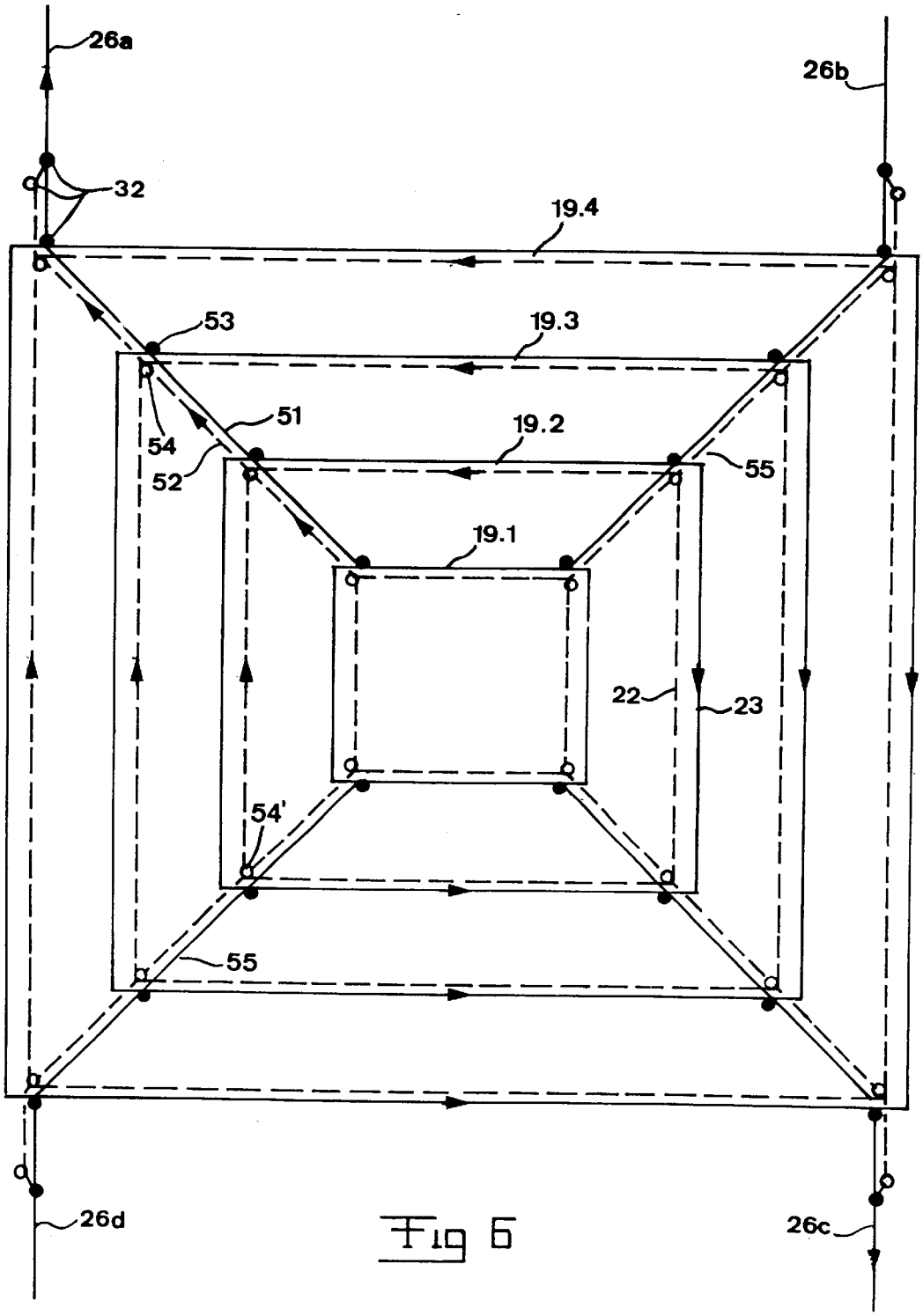
FIG. 6 is a schematic sketch of a part of an arrangement in a drain system according to a third preferred embodiment of the invention.

A possible embodiment in which the main drain conduit is formed by a plurality of ring conduits 19.1, 19.2, 19.3 and 19.4, here in the form of squares, arranged inside each other is schematically illustrated in FIG. 6. These ring conduits are each designed to receive drain water, which in the case shown is separated, from buildings not shown through conduits neither shown, for example in a similar way as illustrated in FIG. 1, but the squares do here correspond to a division into blocks. The different devices for taking care of the drain media are here connected to the outer ring conduit 19.4 through connection conduits 26*a–d*, which are provided with valves 32 for optional drainage of optional drain media at the respective device. Connection conduits 51, 52 are led between the different ring conduits. Valves 53, 54 are arranged at the different points of connection between the conduits 51, 52 and the different ring conduits. The different valves are preferably controlled in the following way: by the way of example we may assume that blue-green water is intended to be transported in the dashed lines 22, 52 and black water in the continuous lines 23, 51. Should it now be decided to drain blue-green water through the conduit 26*a* and black water through the conduit 26*c*, the different valves enabling this are opened, while the valves preventing that any water what so ever comes out into the conduit 26*b* and 26*d* as well as that water of the false type comes out into the conduits 26*a* and 26*c* are closed. It is then also possible to control the different valves 53, 54, so that the water all the time takes the shortest way to the respective device. This means for example that in the case shown in FIG. 6 the valve 54' should control blue-green water coming from the ring conduit 19.1 to go upwardly to the conduit 52 as seen in the figure and not to the right in the figure. Different variations of this embodiment are possible, in which it would for example be well possible to have only one conduit for each square, in which then either water of one type at the time is pumped to one or several devices to take care thereof, or the different valves are controlled in that way and coordinated with a pumping of separated drain water out from different block parts, that for example a half of each ring conduit is used for the transport of drain media of one type, while the other half is used to simultaneously transport drain media of another type. For example black water may in this way be supplied to for example the conduit 26*c* in FIG. 6 and at the same time blue-green water to the conduit 26*a*. The division into the two half would in such a case take place along the diagonal 55.

It appears from the description of the embodiment according to FIG. 6 just made that the claim definition "a closed ring conduit" is to be interpreted as it may also be more than one such there, and that the geometric shape thereof may be arbitrary.

The invention is of course not in any way restricted to the preferred embodiments described above, but many possibilities to modifications thereof.would be apparent to a man skilled in the art without departing from the basic idea of the invention as defined in the claims.

It would for example be possible to separate the drain media in more fractions, for example in the case of drain water in black, blue and green. Furthermore, another drain media than drain water may be transported through the drain system; for example domestic wastes (compost) ground into finer components. The arrangement according to the invention may by this replace the traditional collection of organic domestic wastes in these days, i.e. replace the refuse collection vehicles. The nitrogen and the heat energy are lost in the traditional collection but they may here be utilised if the material is pumped to a biological gas works as described above.

Figure 3:
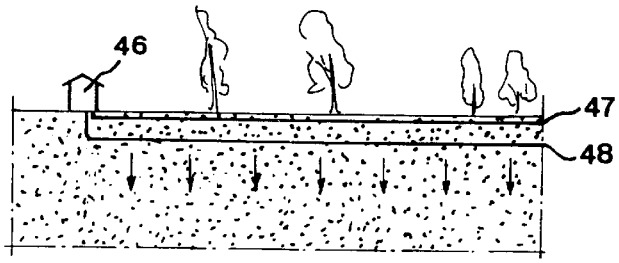
FIGS. 3 and 4 illustrate two different ways to take care of drain water from said buildings in different devices for this purpose.

The watering according to the principle shown in FIG. 3 may very well take place on three different depths, namely:

1. superficial, where plants get contact and organic material is delivered without harmful substances, 2. somewhat deeper, where the roots of the plants do not get contact and heavy metals may be delivered, in which capillary effects may probably supply moisture to the plants, but the heavy metals stay, and 3. deeper below the frost.

Also the landfilling hill according to FIG. 4 may have several, for example three, depths so as to spread water over a large surface for a subsequent filtration down through the hill. Cultivations may in this way be arranged along the entire surface of the hill, in spite of heavy metals.

The ring conduit forming the main drain conduit could have an extension differing substantially from what is shown in the figures and run in the most suitable way through and along the building areas from which drain media is to be collected.

It is not at all necessary that different blocks are provided with a sub-ring conduit in common, but the different buildings could be connected to the main drain ring conduit directly separated, or may be in couples or three and three and so on.

What is claimed is:

1. An arrangement in a drain system, said drain system having a first system section located in a building (6) and arranged to receive drain media from one or a plurality of units, and a second system section having a main drain conduit (19) in common to a plurality of buildings provided with the first system section and arranged to conduct the drain media to one or a plurality of devices (27–31) for taking care thereof, wherein the main drain conduit (19) is structured and arranged as a closed ring conduit, pumping members (17, 18, 42, 43) are structured and arranged to pump the drain media emanating from said first system section to and into the ring conduit (19) for transport therein through pumping action, said devices (27–31) are each connected to the ring conduit (19) through a respective branch (26), and valve members (24, 25, 44, 45) are structured and arranged in each connection to the ring conduit (19) and to either open and allow pumping of the drain media into the ring conduit (19) in the case of a feed connection and drainage from the ring conduit (19) in the case of a device connection, or close to prohibit the drain media from flowing into or out of the ring conduit (19) at said respective connection.

2. The arrangement according to claim 1, wherein said first system section comprises at least one container (15, 16) structured and arranged for collecting the drain media received from said units to enable pumping of the drain media out from the respective container (15, 16) to the main drain conduit (19) through said pumping members (17, 18, 42, 43) at time intervals.

3. The arrangement according to claim 3, wherein said pumping members (17, 18, 42, 43), are connected to different feed connections to the main drain conduit (19) from different buildings or group of buildings and controllable to pump out the drain media into the ring conduit (19) during different periods of time.

4. An arrangement according to claim 2, wherein said containers (15, 16) are arranged in the respective building (6).

5. A device according to claim 1, wherein said first system section comprises at least one collecting conduit (11) for the drain media structured and arranged in common to a group (1–5) of buildings and connecting the buildings of the group of buildings (1–5) in common to the ring conduit (19).

6. An arrangement according to claim 5, wherein said at least one collecting conduit (11) is formed by a closed sub-ring conduit (11) having a branch (12, 13) leading to the main drain conduit (19).

7. An arrangement according to claim 1, wherein at least one of said pumping members (42, 43) is arranged in or in direct connection to each said building (6).

8. An arrangement according to claim 1, wherein one (29) of said devices is a water course structured and arranged for receiving drain water from the main drain conduit (19) of acceptable quality from environmental consideration to be let out into the watercourse.

9. An arrangement according to claim 1, comprising a conduit (26) for connecting a watercourse (29) to the ring conduit (19) and a pumping member (36) arranged in said connection conduit (26) and structured and arranged to pump water from the watercourse (29) out into the ring conduit (19) for the purpose of firefighting, and the ring conduit (19) comprises one or a plurality of water drainage members (37) structured and arranged for utilizing water pumped from the watercourse (29) for the purpose of the firefighting.

10. An arrangement according to claim 1, wherein said ring conduit (19) is provided with at least one ejector pump (38, 39) structured and arranged for influencing the drain media to flow in a certain direction within the ring conduit (19).

11. An arrangement according to claim 10, wherein the ring conduit (19) comprises at least two ejector pumps (38, 39) directed in different directions and separately controllable for optionally adjusting transport direction of the drainage media within the ring conduit (19).

12. An arrangement according to claim 1, wherein tubing or tubings (22, 23) forming the ring conduit (9) have a diameter lower than 100 mm.

13. An arrangement in a drain system, said drain system having a first system section located in a building (6) and arranged to receive drain media from one or a plurality of units, and a second system section having a main drain conduit (19) in common to a plurality of buildings provided with the first system section and arranged to conduct the drain media to one or a plurality of devices (27–31) for taking care thereof, wherein the main drain conduit (19) is arranged as a closed ring conduit, pumping members (17, 18, 42, 43) are structured and arranged to pump the drain media emanating from said first system section to and into the ring conduit (19) for transport therein through pumping action, said devices (27–31) are each connected to the ring conduit (19) through a branch (26), valve members (24, 25, 44, 45) are arranged in each connection to the ring conduit (19) and optionally controllable to either open and allow pumping of the drain media into the ring conduit (19) in the case of a feed connection and drainage of the drain media from the ring conduit (19) in the case of a device connection, or close to prohibit the drain media therein from flowing into or out of the ring conduit (19), said first system section having at least one container (15, 16) arranged for collecting the drain medium received from said units to enable pumping of the drain media out from the respective container (15, 16) to the main drain conduit (19) through the pumping members (24, 25, 44, 45) at time intervals, different buildings in a group (1–5) of said buildings having conduit connections to a location (14) in common and located on a low level for transport of the drain media to said location (14) through influence of gravity and a pumping member (17, 18) is arranged in common at said location (14) to pump the drain media out through a feed conduit to the ring conduit (19).

14. An arrangement in a drain system, said drain system having a first system section located in a building (6) and arranged to receive media from one or a plurality of units, and a second system section having a main drain conduit (19) in common to a plurality of buildings provided with a first system section and arranged to conduct the drain media to one or a plurality of devices (27–31) for taking care thereof, wherein the main drain conduit (19) is arranged as a closed ring conduit, pumping members (17, 18, 42, 43) are structured and arranged to pump the drain media emanating from said first system section to and into the ring conduit (19) for transport therein through pumping action, said devices (27–31) are each connected to the ring conduit (19) through a respective branch (26), valve members (24, 25, 44, 45) are arranged in each connection to the ring conduit (19) and optionally controllable to either open and allow pumping of the drain media into the ring conduit (19) in the case of a feed connection and drainage of the drain media from the drain conduit (19) in the case of a device connection, or close to prohibit the drain media therein from flowing into or out of the ring conduit (19), said first system section is divided into at least two parts, comprising a first part (15) structured and arranged to receive the drain media of a first type from one or a plurality of first units and a second part (16) structured and arranged to receive the drain media of a second, different type from one or a plurality of second units, and said pumping members (17, 18, 42, 43) are structured and arranged to generate a supply of drain media of one type at a time to the ring conduit (19).

15. An arrangement according to claim 14, wherein said first part (15) is structured and arranged to receive first drain water contaminated to a relatively high degree, and said second part (16) is structured and arranged to receive second drain water normally contaminated to a lower degree.

16. An arrangement according to claim 15, wherein said first part (15) is connected to toilets, and said second parts (16) is connected to one or a plurality of second units receiving drain water in the respective building (6).

17. An arrangement according to claim 16, wherein said second units are at least one of sinks, wash-hand basins and dishwashers.

18. An arrangement according to claim 14, wherein one (27) of said devices (27–31) is structured and arranged for producing biological gas from the drain media fed thereto through the main drain conduit (19).

19. An arrangement according to claim 14, wherein one (28) of said devices (27–31) is structured and arranged for cultivation by utilizing the drain media drained from said main drain conduit (19) for at least one of fertilizing and watering.

20. An arrangement according to claim 14, wherein one (31) of said devices (27–31) is formed by a thick ground layer of sand, gravel or another land filling material forming a filter and structured and arranged for purifying contamination fractures present in the drain water delivered from the main drain conduit (19).

21. An arrangement in a drain system, said drain system having a first system section located in a building (6) and arranged to receive drain media from one or a plurality of units, and a second system section having a main drain conduit (19) in common to a plurality of buildings provided with a first system section and arranged to conduct the drain media to one or a plurality of devices (27–31) for taking care thereof, wherein the main drain conduit (19) is arranged as a closed ring conduit, pumping members (17, 18, 42, 43) are structured and arranged to pump the drain media emanating from said first system section to and into the ring conduit (19) for transport therein through pumping action, said devices (27–31) are each connected to the ring conduit (19) through a respective branch (26), valve members (24, 25, 44, 45) are arranged in each connection to the ring conduit (19) and optionally to either open and allow pumping of the drain media into the ring conduit (19) in the case of a feed connection and drainage of the drain media from the ring conduit (19) in the case of a device connection, or closed to prohibit the drain media therein from flowing into or out of the ring conduit (19), said first system section is divided into at least two parts, comprising a first part (15) structured and arranged to receive drain media of a first type from one or a plurality of first units and a second part (16) structured and arranged to receive drain media of a second, different type from one or a plurality of second units, and the respective feed connection to the ring conduit (19) from a respective building or building group (1–5) comprising at least two parallel conduits (9, 10, 12, 13), one for the drain media of each said type, and the ring conduit (19) having at least two conduits (22, 23) extending in parallel for receiving and transporting drain media of different types.

22. A method for taking care of drain media resulting from different buildings (6), comprising the steps of leading the drain media from the different buildings (6) to a main drain conduit (19) in common, leading the drain media through the main drain conduit (19) to one or a plurality of devices (27–31) for taking care thereof, forming the main drain conduit (19) as a closed ring, pumping the drain media into the main drain conduit (19) and transporting the drain media therein through pumping action, arranging branches (26) from the ring conduit (19) to the devices (27–31) and to conduit connections (12, 13, 20, 21, 7, 8) from the buildings (6) to the ring conduit (19), opening or closing the branches (26) from the ring conduit (19) to the devices (27–31) by means of valve members depending upon need to lead a predetermined drain medium to the respective device (27–31), and opening or closing the conduit connections (12, 13, 20, 21, 7, 8) from the buildings (6) to the main drain conduit (19) depending upon need to pump the respective drain media therethrough and into the main drain conduit (19) at a certain moment.

23. A method for taking care of drain media resulting from different buildings (6), in which the drain media from the different buildings are lead to a main drain conduit (19) in common and therethrough to one or a plurality of devices (27–31) for taking care thereof, wherein the drain media is pumped into the main drain conduit (19) which is in the form of a closed ring conduit and transported therein through pumping action, branches (26) from the ring conduit to the devices (27–31) are opened or closed by means of valve members when a predetermined drain medium should be lead to a respective device (27, 31), conduit connections (12, 13, 20, 21, 7, 8) from the buildings (6) to the main drain conduit (19) are opened or closed by means of value members when drain media should be pumped therethrough and into the main drain conduit (19) at a certain moment, the drain media resulting from the buildings (6) are of at least two different types, delivered to different units receiving drain media in the respective building (6), and maintained separate from one another and separately lead to the ring conduit (19), and ultimately to the device or devices (27–31) which are structured and arranged to take care of a particular type of the drain media without intermixing with drain media of different type.

24. A method according to claim 23, wherein the drain media of at least two different types are the drain media having different degrees of contamination.

25. A method according to claim 23, wherein the drain media of different types are lead in parallel and separated from one another to the ring conduit (19), through the ring conduit (19) in parallel (22, 23) and separated from one another there through, and through separate branches to the respective devices (27–31).

26. A method according to claim 23, wherein the drain media of different types are led in one and the same tubing (22 or 23) of the ring conduit (19) during different periods of time to prevent intermixing thereof.

* * * * *